US006652431B1

(12) United States Patent
Mattox

(10) Patent No.: US 6,652,431 B1
(45) Date of Patent: Nov. 25, 2003

(54) SQUAT EXERCISE HOOK HARNESS

(76) Inventor: Ernest M. Mattox, 5440 Highway U., Osceola, MO (US) 64776

( * ) Notice: Subject to any disclaimer, the term of this patent is extended or adjusted under 35 U.S.C. 154(b) by 388 days.

(21) Appl. No.: 09/634,563

(22) Filed: Aug. 9, 2000

Related U.S. Application Data

(60) Provisional application No. 60/150,617, filed on Aug. 24, 1999.

(51) Int. Cl.[7] ..... A63B 71/00

(52) U.S. Cl. ..... 482/139; 482/105; 224/201; 224/265

(58) Field of Search ..... 482/10, 105, 139, 482/148; 224/201, 265, 266

(56) References Cited

U.S. PATENT DOCUMENTS

| | | | | | |
|---|---|---|---|---|---|
| 420,179 | A | | 1/1890 | Yagn | |
| 440,684 | A | | 11/1890 | Yagn | |
| 497,774 | A | | 5/1893 | Denison | |
| 539,872 | A | | 5/1895 | Kheiralla | |
| 821,783 | A | | 5/1906 | Clease | |
| 1,123,570 | A | | 1/1915 | Sandow | |
| 1,265,083 | A | | 5/1918 | Hoard | |
| 1,308,675 | A | | 7/1919 | Kelley | |
| 2,160,722 | A | | 5/1939 | Cunningham | 272/70 |
| 2,722,419 | A | | 1/1955 | Tarapczynski | 272/84 |
| 2,791,999 | A | | 5/1957 | Bustamante | 128/25 |
| 3,049,130 | A | | 8/1962 | Fuschetti | 312/1 |
| 3,162,441 | A | | 12/1964 | Karlik | 272/80 |
| 3,332,593 | A | * | 7/1967 | Fauser | 224/185 |
| 3,614,098 | A | | 10/1971 | Carr | 272/79 |
| 3,820,781 | A | | 6/1974 | Kane | 272/57 |
| 4,018,442 | A | | 4/1977 | Galler | 272/123 |
| 4,057,246 | A | | 11/1977 | Wilson | 272/137 |
| 4,219,193 | A | | 8/1980 | Newman | 272/94 |
| 4,232,863 | A | | 11/1980 | Roach | 272/111 |
| 4,245,840 | A | | 1/1981 | Van Housen | 272/137 |
| 4,274,628 | A | | 6/1981 | Hoagland | 272/123 |
| 4,319,747 | A | | 3/1982 | Rogers | 272/73 |
| 4,335,875 | A | | 6/1982 | Elkin | 272/70 |
| 4,337,938 | A | | 7/1982 | Rodriguez | 272/93 |
| 4,382,596 | A | | 5/1983 | Silberman | 272/118 |
| 4,429,870 | A | | 2/1984 | Gibbs | 272/117 |
| 4,722,524 | A | * | 2/1988 | Waszkelewicz | 482/106 |
| 4,789,154 | A | | 12/1988 | Mattox | 272/94 |
| 5,342,272 | A | * | 8/1994 | Pittroff | 482/106 |

* cited by examiner

*Primary Examiner*—Nicholas D. Lucchesi
*Assistant Examiner*—Tam Nguyen
(74) *Attorney, Agent, or Firm*—McGarry Bair PC

(57) ABSTRACT

A squat exercising hook harness comprising a pair of generally parallel aligned bars interconnected and spaced by a joining member to accommodate the neck of a person therebetween. The aligned bars each include bends therein that define a base section and a chest section. The chest sections are spaced by the base sections from the joining member. The base sections define a base plane and the chest sections form an obtuse angle in combination with the base sections. Each free end of the chest sections has an upturned portion at the end. A T-member has a leg and a cross bar connected to a first end of the leg. A second end of the leg is connected to a midpoint of the joining member so that the T-member extends from the joining member in an inverted fashion and defines an angle between the range of 60 degrees to 120 degrees with the base plane.

34 Claims, 5 Drawing Sheets

SQUAT EXERCISE HOOK HARNESS

This application claims the benefits of the earlier filed U.S. Provisional Application Ser. No. 60/150,617, filed on Aug. 24, 1999, which is incorporated by reference for all purposes into this application.

BACKGROUND OF THE INVENTION

The present invention relates to exercise equipment, and in particular to portable exercise devices used by individuals.

Bodybuilding and weightlifting are popular sports and are gaining popularity as a recreational sport for many individuals desiring to improve their appearance and to maintain a healthy and strong body. One of the most widely recognized and most popular exercises utilized by bodybuilders and weightlifters is the 'squat'. Generally, a back squat involves placing a barbell of weights across one's shoulders and squatting down and raising back up for a number of repetitions. An alternative method is the front squat. In a front squat, the barbell is held by the lifter against his chest. The squat is known for its importance to athletes in building muscle mass. The popularity and importance of the squat is that it is the main lower body exercise and involves most of the major muscles in the body, thus providing an extensive workout for a number of muscles in one exercise. The squat exercise provides strength and power for all leg movements.

Although the squat exercise is popular and important for body builders and weight lifters, if not performed correctly, the squat can cause damage to the lifter's knees. If improper form is used, excessive and detrimental forces are imparted to the knees and ligaments located at the knee from the large weights lifted during the squat. Additional potential problems from improper form include a variety of back injuries. The lower back can be 'thrown out' if the lifter's back is rounded or if the lifter leans too far forward. Since the bar to which the weight is attached is carried across the lifter's shoulders, the lifter must lean forward to maintain the combined weight of the lifter's body and the barbell aligned with the lifter's center of gravity. The bar also rests on and places significant pressure on the lifter's backbone in the area of the seventh cervical vertebra, which can cause soreness and injury to this area of the body. The front squat eliminates the need for resting the barbell on the lifter's shoulders and putting pressure on his vertebrae, since the barbell is held by the lifter against his chest, using his arms as the primary mode of support. Additionally, the front squat moves the lifted weight farther forward on the lifter's body, thus promoting a straighter and more upright form for the torso. However, the difficulty associated with performing front squats is that the lifted weight and number of repetitions are potentially limited by how long the lifter can support the weight of the barbell with his arms.

Because of the popularity of bodybuilding and weight lifting and the critical need to maintain proper form while performing squat exercises, there exists a need for insuring that squat exercises are performed using proper technique and form to prevent the occurrence of serious injuries to the lifter.

SUMMARY OF THE INVENTION

One aspect of the present invention is a squat exercise hook harness comprising a pair of generally parallel aligned bars interconnected and spaced by a joining member to accommodate the neck of a person therebetween. The aligned bars each include bends therein that define a base section and a chest section. The chest sections are spaced by the base sections from the joining member. The base sections define a base plane and the chest sections form an obtuse angle in combination with the base sections. Each free end of the chest sections has an upturned portion at the end. A T-member has a leg and a cross bar connected to a first end of the leg. A second end of the leg is connected to a midpoint of the joining member so that the T-member extends from the joining member in an inverted fashion and defines an angle between the range of 60 degrees to 120 degrees with the base plane.

Another aspect of the present invention is a squat exercise hook harness for assisting a person in performing squat exercises. The harness comprises a generally U-shaped frame to receive the neck of a user at an apex of the U-shape therein. The U-shape further defines two legs thereof and includes load attach points at free ends of the legs. A shoulder support is affixed to and extends from the apex of the U-shaped frame.

Yet another aspect of the present invention is a squat exercise machine for performing squat exercises. The exercise machine comprises a harness including a generally U-shaped frame to receive the neck of a user at an apex of the U-shape. The U-shape further defines two legs thereof and includes load attach points at free ends of the legs. A generally upright frame is supportable by a floor surface and includes a plurality of vertically spaced handles for grasping by the user. A resistive load is attached to the attach points of the harness.

These and other features, advantages and objects of the present invention will be further understood and appreciated by those skilled in the art by reference to the following specification, claims and appended drawings.

DETAILED DESCRIPTION OF A PREFERRED EMBODIMENT

Figure 1:
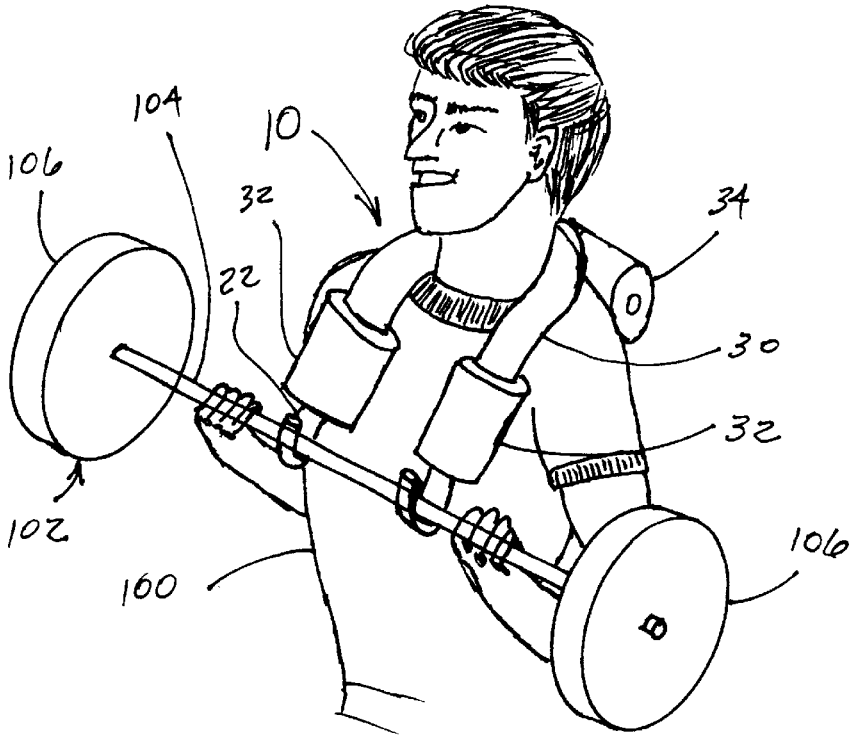
FIG. 1 is a fragmentary perspective view of a hook squat harness embodying the present invention, shown in use by a weightlifter with a barbell supported by the harness.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
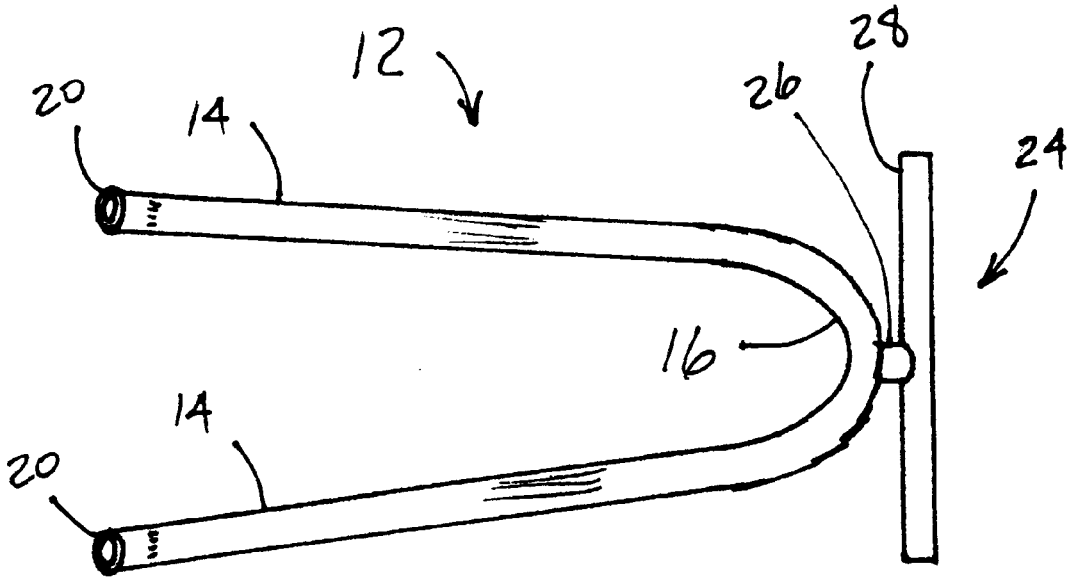
FIG. 3 is a top plan view of the hook squat harness frame.
Figure 4:
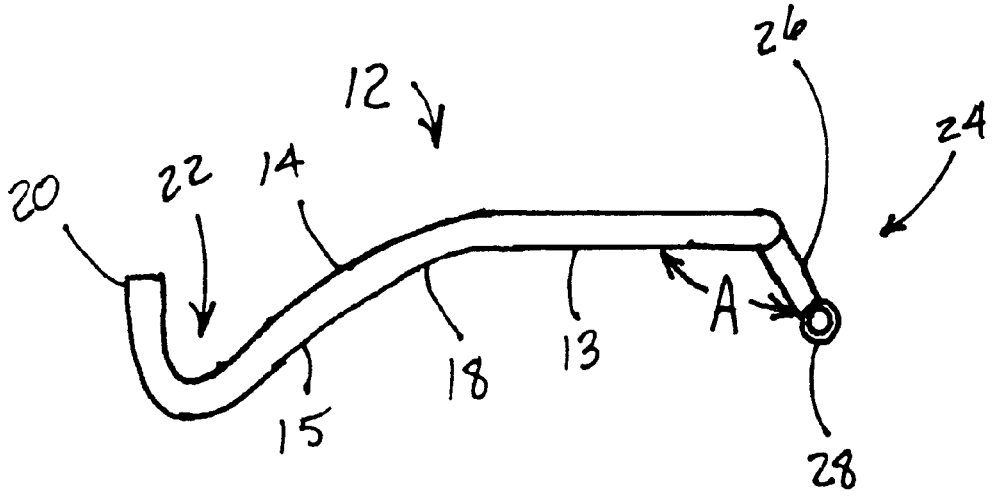
FIG. 4 is a side elevation view of the hook squat harness frame.

An exercise hook harness embodying a preferred configuration of the invention is illustrated in the drawings and is generally designated in FIG. 1 by the reference numeral 10. The harness 10 comprises a frame 12 as shown in FIGS. 3 and 4. Frame 12 includes a pair of spaced and aligned bars 14 that are interconnected by a joining bar 16. Joining bar 16 spaces aligned bars 14 to adapt frame 12 to fit around the neck of a person and to extend to the front of the person. Each bar 14 has a bend 18 generally conforming bars 14 to the front contour of the user's body and maintain close proximity to the user's chest. Free ends 20 of bars 14 are upturned to define hook 22. A T-member 24 including a leg 26 and cross member 28 is attached to a midpoint of joining member 16 in an inverted manner.

Aligned bars 14 and joining bar 16 are formed from a unitary length of steel tubing having a diameter of approximately one inch that is bent to the desired configuration. As shown in FIG. 4, bends 18 are smoothly curved dividing bars 14 into a base segment 13 and a chest segment 15. Base segments 13 define a base plane, and chest segments 15 depend from this base plane to generally define an included angle of approximately 120 degrees with base segments 13. Preferably, base segments 13 are approximately five inches long from a tangent to joining bar 16 to the start of bend 18. Chest segments 15 are preferably ten inches long from the base plane to hooks 22, and can be continuously curved to approximate the curvature of a human chest, and can also be adjustable in length to accommodate different sized torsos. The ends of frame 12 from free end 20 to hook 22 are approximately four inches long. When harness 10 is positioned about a user's neck, the end segments of frame 12 are approximately forty-five degrees from the vertical and extend away from the user's body.

Joining bar 16 is a smoothly curved semicircular section that spaces aligned bars 14 so as to be adapted to the width of a person's neck. Curved joining bar 16 preferably has a curve diameter of about seven and one-half inches, and therefore aligned bars 14 are spaced that distance adjacent joining bar 16. Aligned bars 14 diverge slightly from joining bar 16 so that free ends 20 are preferably spaced approximately fourteen inches. The diverging of bars 14 provides a funneling effect for the neck of the user to facilitate proper placement of harness 10 on the user. The term "aligned bars" as used herein refers to the extension of bars 14 to the same side of joining bar 16 and the general alignment of aligned bars 14 in elevation view shown in FIG. 3. The term "aligned bars" as used herein encompasses the outward divergence of aligned bars 14. Alternatively, aligned bars 14 may extend generally parallel to each other, and will therefore be additionally "aligned" in this fashion.

The base plane, defined by base segments 13, and in combination with leg 26 of member 24, define angle 'A'. Although angle 'A' is fixed in the preferred embodiment of harness 10, member 24 can also be made adjustable to accommodate different body types and shoulder configurations, such as large bodies and large shoulders requiring a larger angle 'A' than a smaller body or a body with less developed shoulders. Typically, angle 'A' is within the range of 60 degrees to 120 degrees, and optimally is approximately 105 degrees. Cross member 28 of T-member 24 is generally parallel to the base plane defined by base segments 13.

Figure 5:
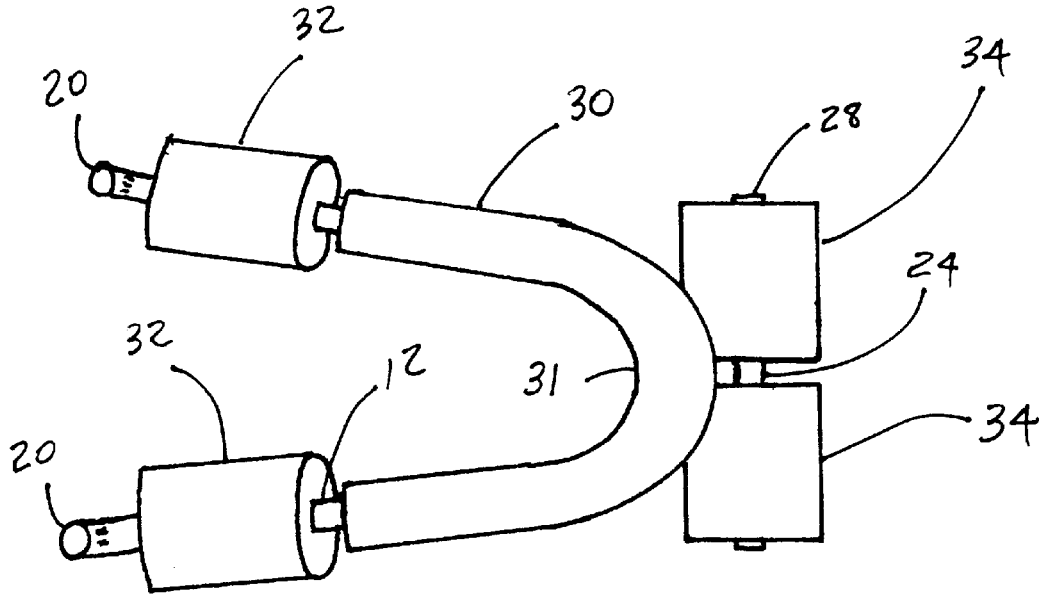
FIG. 5 is a top plan view of the hook squat harness including foam pads
Figure 6:
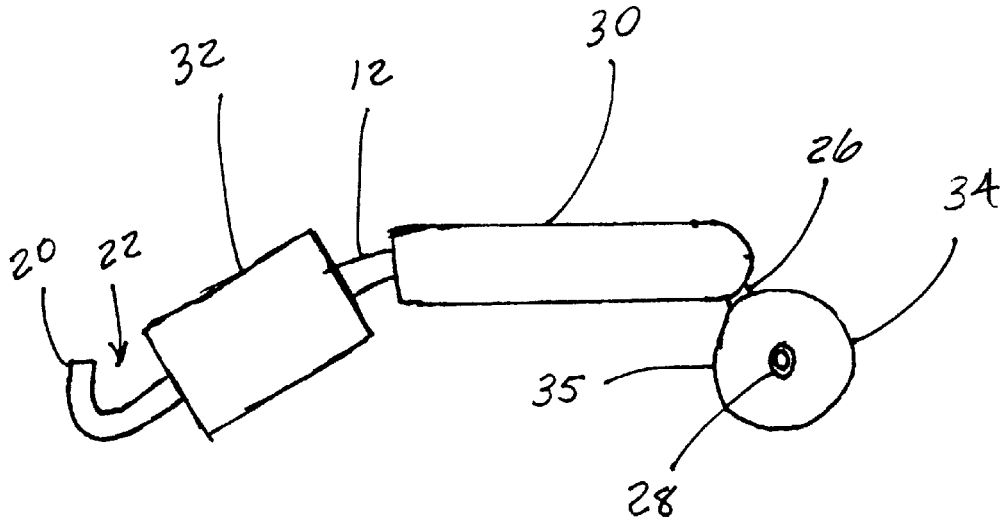
FIG. 6 is a side elevation view of the hook squat harness including foam pads.

As shown in FIGS. 5 and 6, while not required, frame 12 can optionally be covered with elastomeric pads to form bearing surfaces to contact the neck, chest and shoulders of the user. A first elastomeric pad 30 of preferably a tubular polyurethane or polyethylene foam approximately two and one-half inches in diameter is sleeved over base segments 13 and joining member 14, extending between bends 18. Other elastomeric padding may be used that has a surface texture and configuration that is comfortable when brought into contact with the user's neck. Larger diameter tubular chest pads 32 are sleeved over chest segments 15. Chest pads 32 are approximately four inches in diameter and seven inches long and are also made from a resilient elastomeric material. Pads 32 are typically made from a material of lower compressive resistance to provide cushioning to the chest area of the user. Optional shoulder pads 34 can be sleeved over the ends of cross bar 28 of inverted T-member 24 to provide protection for the lifter's spine. Shoulder pads 34 are made from the same material and are approximately the same size as chest pads 32 to cushion the shoulder area of the user.

Shoulder pads 34 have a shoulder contacting surface 35 which is roughly aligned with a contact surface 31 of pad 30. Since the diameter of pads 34 and 30 are of different diameters, a line which is tangent to both the contacting surfaces 35 and 31 also defines an angle with respect to the base plane defined by base segments 13. This defined angle can be different that angle 'A' as defined above and can be within the range of 60 degrees to 135 degrees with the most preferred angle being 90 degrees.

Figure 2:
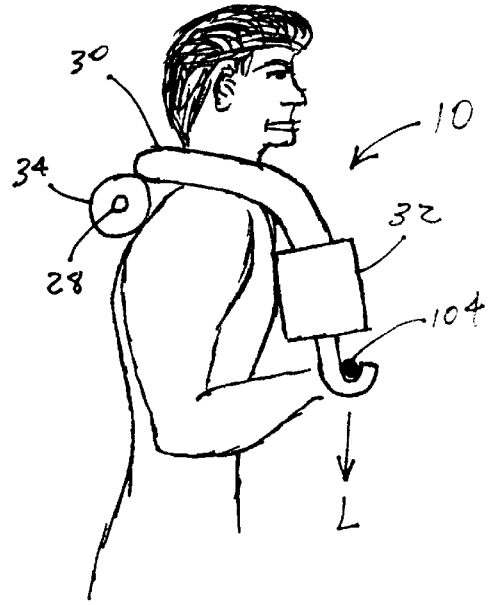
FIG. 2 is a side elevation view of the harness in use.

In use, as shown in FIGS. 1–2, a user 100 has a harness 10 according to the preferred embodiment placed around his neck in a manner that shoulder pads 34 rest on and contact an upper portion of his shoulders, pad 30 encircles a rear portion of his neck and extends downwardly across the front of his shoulders, and chest pads 34 rest on the upper portion of the user's chest area. A barbell 102 having an elongated bar 104 with weights 106 attached to the ends of bar 104 are placed in and retained in hooks 22 of harness 10. The user now can perform front squats. As shown in FIG. 2, the weight of barbell 102 exerts a vertical load 'L' on harness 10. This load is transferred to the body of the user 10 through shoulder pads 34 and chest pads 32 without placing strain on the users neck through pad 30. The simultaneous distribution of load 'L' on the rear of the shoulders and the chest of user 10 promotes a more upright posture by distributing the load closer to the combined upright center of gravity of the user. Thus, the user automatically utilizes proper form when performing squats.

Figure 7:
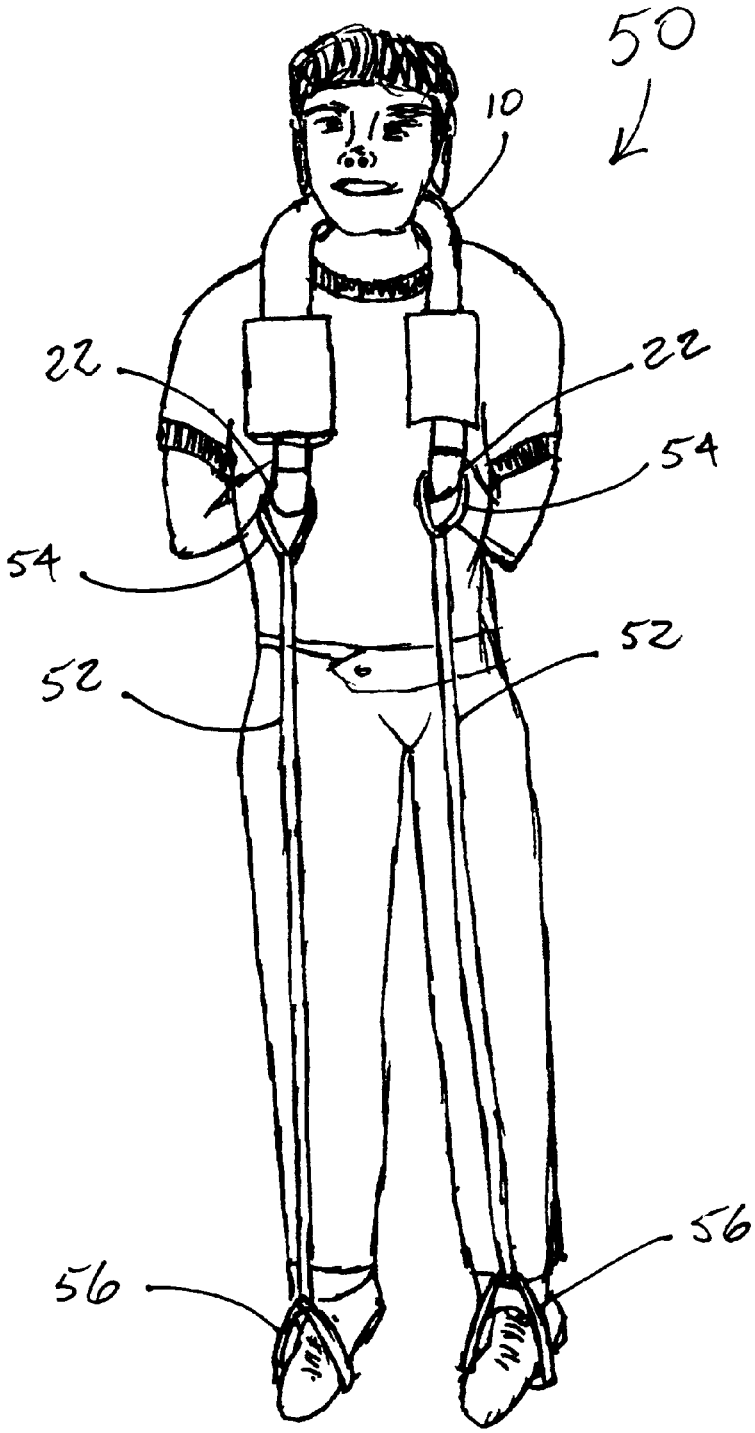
FIG. 7 is a front elevation view of a hook squat harness shown in use by a weightlifter using elastic cords to provide a resistance force.

An alternate embodiment 50 of the harness is shown in FIG. 7 wherein one or more resistive elastic cords 52 are substituted for barbell 102. Cords 52 have a loop 54 at an upper end and are looped over hooks 22 of harness 10. Stirrups 56 are at an opposite end of elastic cords 52 into which the feet of the user are placed or which are attached to floor anchors (not shown). As the user performs squats with embodiment 50, the resistive force of elastic cords increases as the cords are continued to be stretched. Thus, elastic cords provide a variable and increasing resistive load applied at hooks 22 and is also more stable than a barbell 104. Alternatively, cords 52 can be combined into one continuous cord where the ends are anchored either on harness 10, the feet of the user, or to floor anchors (not shown).

Figure 8:
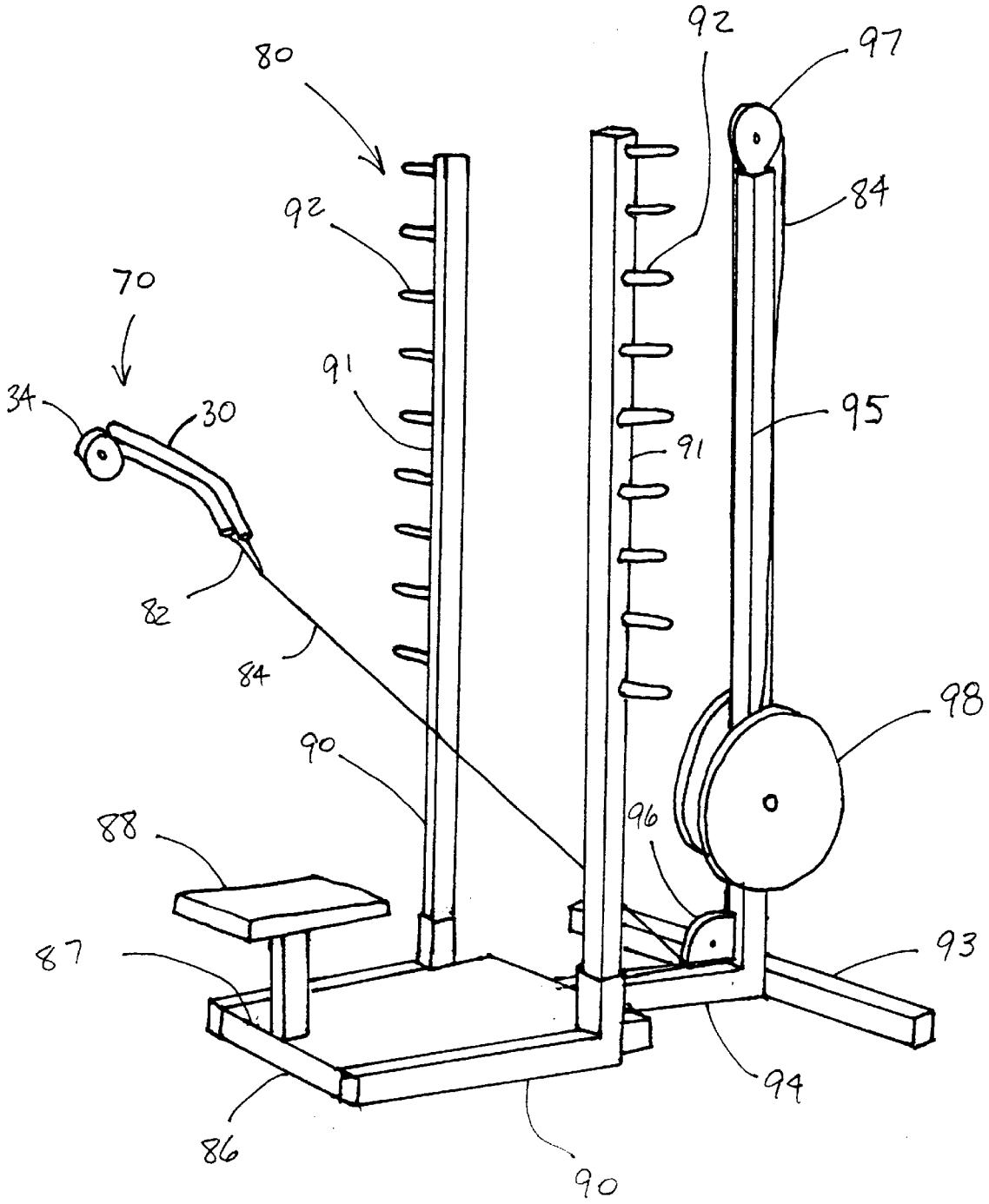
FIG. 8 is a perspective view of a squat machine in combination with an alternate embodiment of the harness.

Yet another embodiment is illustrated in FIG. 8, where a harness 70 is used in combination with a squat machine 80. Harness 70 is similar to harness 10 excluding chest pads 32 and the hooks 22. Harness 70 includes a frame, elastomeric pad, and shoulder pads as discussed above. Squat machine 80 includes a platform 86 on which a user can stand. A user's seat 88 is affixed to a rear edge 87 of platform 86, thus permitting the user to either stand or sit without dismounting from squat machine 80. 'L' shaped uprights are attached to each side of platform 86 in such a manner that the long leg 91 of each upright extends vertically upward from each side of platform 86. A plurality of regularly spaced handles 92 extend outwardly from each leg 91 with handles 92 on each leg 91 defining parallel pairs of handles 92. A third upright 94 extends away from platform 86 opposite seat 88 and includes vertical leg 95 with lower pulley 96 at its base and upper pulley 97 at its top. An adjustable weight 98 is vertically movable along vertical leg 95. A cable 84 is attached to harness 70 with yoke 82 such that yoke 82 is connected to each end of the harness frame and the end of cable 84. Cable 84 also extends through lower pulley 96 and upper pulley 97 with its other end connected to weight 98.

In use, a user (not shown) adjusts weight 98 to a desired resistance in manners well known in the-weight lifting arts and, while sitting on seat 88, places harness 70 over his or her shoulders in the same manner as discussed above with respect to harness embodiment 10. Cable 84 is of a length that weight 98, when at its lowermost position with respect to leg 95, correlates to a squatting position for the user. The user can now raise and lower his or her body while standing on platform 86 to perform the desired squatting exercises without the need for one or more spotters as is required while using free weights. The user, for stabilizing himself while performing the exercise, can grip handles 92. Harness 70 places the total resistive weight of the exercise on the user's shoulders with pads 34 and, since the weight is again effectively in front of the user, more closely directs the force through the user's center of gravity, thereby encouraging proper lifting form with minimal adverse forces on the user's back. Additionally, through applying either upwards force against handles 92, or downward force against handles 92, the user can effectively vary the force of weight 98 being translated by the user's body movements. Handles 92 can also be used to accelerate the body's movements, thus providing a variety exercises for a total body workout.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the Doctrine of Equivalents.

I claim:

1. A squat exercise hook harness, comprising:

a pair of generally parallel aligned bars, said aligned bars being interconnected and spaced by a joining member so as to accommodate the neck of a person therebetween;

said aligned bars each including bends therein that define a base section and a chest section thereof, said chest sections being spaced by said base sections from said joining member and defining an obtuse angle in combination with said base sections, and further wherein said base sections define a base plane;

an upturned portion at each free end of said chest sections; and a T-member having a leg and a cross bar connected to a first end of said leg and a second end of said leg connected to a midpoint of said joining member, wherein said T-member extends from said joining member in an inverted fashion and defines an angle between the range of 60 degrees to 120 degrees with said base plane.

2. A harness according to claim 1 wherein said T-member and said base plane define an angle of approximately 105 degrees.

3. A harness according to claim 1 wherein said T-member, said aligned bars and said joining member include at least a first resilient pad attached to said aligned bars and said joining member, and at least a second resilient pad attached to said T-member for cushioning said harness on the body of the user.

4. A harness according to claim 3 wherein said at least first resilient pad on said aligned bars and said joining member define a first bearing surface and said at least second resilient pad on said T-member further defines a second bearing surface for contacting the user's body.

5. A harness according to claim 4 wherein said first bearing surface and said second bearing surface define an angle within the range of 60 degrees to 135 degrees.

6. A harness according to claim 5 wherein said first bearing surface and said second bearing surface define an angle of approximately 90 degrees.

7. A squat exercise hook harness for assisting a person in performing squat exercises, said harness comprising:

a generally U-shaped frame to receive the neck of a user at an apex of said U-shape therein, said U-shape further defining two legs thereof and including load attach points at free ends of said legs; and a shoulder support separate from said U-shaped frame and attached to said U-shared frame at the apex thereof.

8. A harness according to claim 7 wherein each of said two legs includes a bend shape for general conformance to the chest contour of an average user.

9. A harness according to claim 8 wherein said U-shaped frame defines a base plane and said shoulder support extends from said apex to define with said base plane an included angle within the range of 60 degrees to 120 degrees.

10. A harness according to claim 9 wherein said included angle is approximately 105 degrees.

11. A harness according to claim 8 wherein said U-shaped frame further includes a first resilient pad attached thereto defining a first bearing surface for contacting the user's body, and said shoulder support further includes a second resilient pad attached thereto defining a second bearing surface for contacting the user's body, said first bearing surface and said second bearing surface defining an included angle between 60 and 135 degrees.

12. A harness according to claim 11 wherein said first bearing surface and said second bearing surface define an angle of approximately 90 degrees.

13. A harness according to claim 7 wherein said shoulder support is a T-shaped member and extends from said apex in an inverted manner.

14. A squat exercise hook harness for assisting a wearer with performing leg squats with a resistive load, comprising:

a unitary frame comprising a pair of interconnected aligned bars, each having a chest segment adapted to extend vertically along the chest of the user and a free end at a lower portion thereof, a base segment extending rearwardly from an upper portion of the chest segment and adapted to extend over the user's shoulders, and the frame further comprising a load supporting member connected to and extending transversely of the base segments, the load supporting member adapted to rest on the user's upper shoulders;

a hook at each free end adapted to support the resistive load; and wherein the chest segments, the base segments and the load supporting member are so shaped and positioned with respect to each other that the resistive load mounted to the hooks on each free end is supported by the load supporting member on the user's upper shoulders without placing strain on the neck of the user.

15. A squat exercise hook harness according to claim 14 wherein the chest segments, the base segments and the load supporting member are so shaped and positioned with respect to each other that the resistive load mounted to the hooks on each free end is also supported by the chest segments.

16. A squat exercise hook harness according to claim 15 wherein the unitary frame terminates at the load supporting member.

17. A squat exercise hook harness according to claim 16 wherein at least the chest segments and the load supporting member have pads to cushion the force of these elements against the body of the user.

18. A squat exercise hook harness according to claim 17 wherein the base segments are joined together by a curved segment, the curved segment has a pad with a contact surface adapted to contact the user above the load supporting member pad, and wherein the load supporting member pad has a contact surface that is adapted to rest on the upper shoulders of the user, and the curved segment pad contact surface and load supporting member pad contact surface define a line between them that is at an angle between 60 and 135 degrees with a plane defined by the base segments.

19. A squat exercise hook harness according to claim 18 wherein the included angle between the line extending between the curved segment pad contact surface and the load supporting member pad contact surface and the plane defined by the base segments is about 90 degrees.

20. A squat exercise hook harness according to claim 14 wherein the load supporting member comprises a T-shaped member comprising a leg having a first end and a second end and a cross-bar connected to the first end of said leg.

21. A squat exercise hook harness according to claim 20 wherein the base segments are joined by a curved section and the leg of the T-shaped member is connected to the curved section.

22. A squat exercise hook harness according to claim 21 wherein said base segments define a base plane, and said load supporting member and said base plane define an included angle between them of between 60 and 120 degrees.

23. A squat exercise hook harness according to claim 22 wherein said load supporting member and said base plane define an included angle between them of about 105 degrees.

24. A squat exercise hook harness according to claim 18 wherein the resistive load comprises a barbell.

25. A squat exercise hook harness according to claim 18 wherein the resistive load comprises at least one elastic cord.

26. A squat exercise hook harness according to claim 22 wherein at least the chest segments and the load supporting member have pads to cushion the force of these elements against the body of the user.

27. A squat exercise hook harness according to claim 26 wherein the base segments are joined together by a curved segment, the curved segment has a pad with a contact surface adapted to contact the user above the load supporting member pad, and wherein the load supporting member pad has a contact surface that is adapted to rest on the upper shoulders of the user, and the curved segment pad contact surface and load supporting member pad contact surface define a line between them that is at an angle between 60 and 135 degrees with a plane defined by the base segments.

28. A squat exercise hook harness according to claim 27 wherein the included angle between the line extending between the Scuived segment pad contact surface and the load supporting member pad contact surface and the plane defined by the base segments is about 90 degrees.

29. A squat exercise hook harness according to claim 14 wherein the load supporting member comprises a T-shaped member comprising a leg having a first end and a second end and a cross-bar connected to the first end of said leg.

30. A squat exercise hook harness according to claim 29 wherein the leg of the T-shaped member is connected to the bight section.

31. A squat exercise hook harness according to claim 30 wherein said base segments define a base plane, and said load supporting member and said base plane define an included angle between them of between 60 and 120 degrees.

32. A squat exercise hook harness according to claim 31 wherein said load supporting member and said base plane define an included angle between them of about 105 degrees.

33. A squat exercise hook harness according to claim 32 wherein the resistive load comprises a barbell.

34. A squat exercise hook harness according to claim 32 wherein the resistive load comprises at least one elastic cord.

* * * * *